US007942801B2

(12) United States Patent
Ryu et al.

(10) Patent No.: US 7,942,801 B2
(45) Date of Patent: May 17, 2011

(54) AUTOMATIC BALANCING CENTRIFUGE USING BALANCER

(75) Inventors: Heuigeun Ryu, Seoul (KR); Ohhun Kwon, Seoul (KR); Sungha Chang, Seoul (KR)

(73) Assignee: Hanlab Corporation, Paju-si (KR)

( * ) Notice: Subject to any disclaimer, the term of this patent is extended or adjusted under 35 U.S.C. 154(b) by 0 days.

(21) Appl. No.: 12/202,606

(22) Filed: Sep. 2, 2008

(65) Prior Publication Data

US 2010/0009835 A1 Jan. 14, 2010

(30) Foreign Application Priority Data

Jul. 9, 2008 (KR) ..... 10-2008-0066371

(51) Int. Cl.
*B04B 9/14* (2006.01)

(52) U.S. Cl. ..... 494/82; 74/572.4

(58) Field of Classification Search ..... 494/1, 10, 494/12, 16–21, 33, 82, 84; 73/457–458; 210/85, 144; 68/23.1, 23.2; 74/570.2, 571.1, 74/572.4

See application file for complete search history.

(56) References Cited

U.S. PATENT DOCUMENTS

| | | | | |
|---|---|---|---|---|
| 1,254,694 | A * | 1/1918 | Humphries | 74/570.2 |
| 3,692,236 | A * | 9/1972 | Livshitz et al. | 494/20 |
| 4,433,592 | A * | 2/1984 | Tatsumi et al. | 74/570.2 |
| 5,460,017 | A * | 10/1995 | Taylor | 68/23.2 |
| 5,592,858 | A * | 1/1997 | Taylor | 74/571.1 |
| 5,605,078 | A * | 2/1997 | Taylor et al. | 74/571.1 |
| 5,613,408 | A * | 3/1997 | Taylor et al. | 74/571.1 |
| 5,711,190 | A * | 1/1998 | Taylor et al. | 74/570.2 |
| 5,724,862 | A * | 3/1998 | Hannah et al. | 74/570.2 |
| 5,746,069 | A * | 5/1998 | Kim | 68/23.2 |
| 5,761,932 | A * | 6/1998 | Kim | 68/23.2 |
| 5,768,951 | A * | 6/1998 | Hannah et al. | 74/570.2 |
| 5,782,110 | A * | 7/1998 | Kim | 68/23.3 |
| 5,806,349 | A * | 9/1998 | Kim et al. | 68/23.2 |
| 5,816,115 | A * | 10/1998 | Taylor et al. | 74/570.2 |
| 5,829,318 | A * | 11/1998 | Hannah et al. | 74/570.2 |
| 5,845,542 | A * | 12/1998 | Hannah et al. | 74/570.2 |
| 5,916,274 | A * | 6/1999 | Lee et al. | 68/23.2 |
| 6,116,112 | A * | 9/2000 | Sohn | 74/570.2 |
| 6,132,354 | A * | 10/2000 | Ohtsu et al. | 494/16 |
| 6,658,902 | B2 * | 12/2003 | Southworth et al. | 68/23.2 |
| 6,731,588 | B2 * | 5/2004 | Han | 369/264 |
| 7,159,952 | B2 * | 1/2007 | Koschel et al. | 301/5.22 |
| 7,435,211 | B2 * | 10/2008 | Kim et al. | 494/82 |
| 2004/0003678 | A1 * | 1/2004 | Neubauer et al. | 74/573 R |
| 2010/0009835 | A1 * | 1/2010 | Ryu et al. | 494/82 |
| 2010/0069216 | A1 * | 3/2010 | Ryu et al. | 494/37 |

FOREIGN PATENT DOCUMENTS

| | | | |
|---|---|---|---|
| DE | 2711561 | A1 * | 9/1978 |
| DE | 3509089 | A1 * | 4/1986 |
| DE | 10227013 | A1 * | 1/2004 |
| JP | 54000471 | A * | 1/1979 |
| JP | 54120957 | A * | 9/1979 |

(Continued)

*Primary Examiner* — Charles E Cooley
(74) *Attorney, Agent, or Firm* — Rothwell, Figg, Ernst & Manbeck, P.C.

(57) ABSTRACT

The present invention relates to a centrifuge including a balancer which contains balls and liquid and enables a rotor to rotate steadily. More concretely, the centrifuge comprises a motor, a motor shaft protruded from the motor, a rotor, and a balancer which includes a space constructed with a balancer body and a cover unit combining with the balancer body and formed to contain balls and liquid.

4 Claims, 16 Drawing Sheets

FOREIGN PATENT DOCUMENTS

| | | | | |
|---|---|---|---|---|
| JP | 58037353 | A | * | 3/1983 |
| JP | 59-183846 | | * | 10/1984 |
| JP | 02203949 | A | * | 8/1990 |
| JP | 11156243 | A | * | 6/1999 |
| RU | 2210014 | C2 | * | 8/2003 |
| WO | 98/01733 | | * | 1/1998 |
| WO | WO 9809096 | A1 | * | 3/1998 |
| WO | WO 14493 | A2 | * | 3/2000 |
| WO | 00/29122 | A1 | * | 5/2000 |

* cited by examiner

AUTOMATIC BALANCING CENTRIFUGE USING BALANCER

CROSS REFERENCE TO RELATED APPLICATIONS

This application claims priority from Korean patent application No. 10-2008-0066371 filed on Jul. 9, 2008, all of which is incorporated herein by reference in its entirety for all purposes.

BACKGROUND OF THE INVENTION

1. Field of the Invention

The present invention relates to a centrifuge equipped with a balancer, particularly, to a centrifuge equipped with the balancer which contains balls and liquid to reduce force and moment generated due to the weight imbalance among samples loaded a rotor and makes the rotor rotate more steadily. The balancer reduces vibration of the centrifuge, prolongs lifetime of the centrifuge and the rotor, and enhances the efficiency of the centrifugal separation.

2. Description of the Related Art

To accelerate settling of materials melt in fluid or suspended materials contained in a suspension, centrifugal force is used instead of gravity. This process is referred as centrifugal separation.

A centrifuge used for the centrifugal separation is an apparatus using a phenomenon that high density particles move to the edge and low density particles concentrate on the center in a suspension due to the centrifugal force. An example of a structure of the centrifuge is shown in FIGS. 1*a* and 1*b*.

As shown in FIGS. 1*a* and 1*b*, a centrifuge is configured with a buffer member 30 such as the anti-vibration rubber and damper set up on first supporting plate 15 formed in the inner side of a case 10 of the centrifuge and a bracket or second supporting plate 35 installed on the buffer member 30.

Also, a configuration of the centrifuge includes a motor 50 beneath the bracket or the second supporting plate 35 and a rotor 200 or 200*a* on a shaft 40 protruded from the motor 50.

The centrifuge uses different types of rotors according to the usage and there are two general types of rotors such that a swing-out rotor 200*a*, which rotates perpendicularly to the shaft of the motor, and a fixed-angle rotor 200 which has a space rotating with fixed angle. The fixed-angle rotor 200 may include a plurality of chambers 60.

The motor 50 in the centrifuge rotates at high speed and gives a big strong centrifugal force to samples within bottles or test tubes loaded into the swing-out rotor or the fixed-angle rotor. Therefore, the centrifuge separates the materials contained within the samples by the difference of the centrifugal forces due to the difference of densities between the materials.

A big centrifugal force has to be given to the samples for the separation of the materials within the samples. High speed rotation of the rotor is generally required in order to generate a big centrifugal force to the samples and particularly vibration should not be generated by the high speed rotation of the rotor.

However, during the high speed rotation of the centrifuge, vibration is generated by a bending motion of the shaft of the motor, a whirling motion due to the weight imbalance of the rotor, and influences by the other external factors. And the whirling motion by the weight imbalance of the rotor is the main factor among these reasons of the vibration.

Accordingly, in the centrifuge without a balancer, an operator measures independently the weight of each sample in advance before the centrifugal separation operation in order to remove the weight imbalance of the rotor generated due to the difference in the number of samples loaded into the rotor or due to the difference in the weight of each sample. Therefore, there has been an inconvenience that an operator should perform the centrifugal separation that after removing the weight difference between the opposite-side samples. If the weight imbalance between the opposite-side samples exists, materials within the samples are not separated due to the vibration generated during the centrifugal separation process. Although materials might be separated, the materials might be mixed again by the vibration.

Furthermore, during the centrifugal separation process, some noise may be generated by the vibration.

In the centrifuge, there has been a problem that a force or a moment is generated due to the weight imbalance among samples and it causes a disorder of the centrifuge itself.

To resolve the problem of the noise and the vibration generated during the centrifugal separation process, the buffer member such as damper and rubber may be included. But the buffer member still has a problem that noise and vibration are not absorbed enough.

Therefore, to resolve the problems of noise and vibration generated due to the weight imbalance among samples, the centrifuge equipped with a balancer including balls has been proposed.

The ball balancer (hereinafter, it is referred as Conventional Technology 1) shown in FIG. 2*a* contains a plurality of balls 420 in the case 400 forming the balancing space 410 shaped as a circular ring and has an axis hole 430 at the center to fix the shaft of the motor.

Thus, the ball balancer includes balls 420 to fill some portion of the balancing space 410 formed inside of the case 400 and has the advantage that if the rotational speed of the motor (not illustrated) is above the resonance speed then rotation is stable because the balls move to the opposite side of the weight imbalance amount and the rotor (not illustrated) is balanced.

But there is a disadvantage that if the rotational speed of the rotor is below the resonance speed then the rotor is more unstable because the balls 420 rather move to the side where the weight imbalance exists.

To resolve the problem of the ball balancer of Conventional Technology 1, the ball balancer shown in FIG. 2*b* (hereafter, it is referred as Conventional Technology 2) has been proposed.

The ball balancer has the balancing space 410*a* formed to be inclined from the center of a case 400*a* having a hollow to the edge and includes balls 420*a* which fill up the groove part of the edge of the balancing space 410*a* formed within the case 400*a*.

The ball balancer has an axis hole 430*a*.

The ball balancer may prevent the unstable rotation occurred at the time of low-speed rotation under the resonance speed because the balls 420*a* locate near the center of rotation at that time.

Furthermore, if the motor rotates at high speed above the resonance speed then balls are floated by the centrifugal force and move to the opposite side to compensate the weight imbalance amount. Thus, the ball balancer has an advantage of vibration and noise reduction because the rotor rotates at a stable state.

However, in case of the ball balancer shown in FIG. 2*b*, if the rotational speed of the motor increases over the resonance speed starting from the initial low speed then it takes some time for the balls to move to the opposite side to compensate weight imbalance amount. Therefore, the ball balancer has a disadvantage that it does not have sufficient effect of vibration attenuation because vibration is created at this moment.

SUMMARY OF THE INVENTION

Technical Problem

The following description is proposed to resolve the problems described above. Provided is a centrifuge equipped with a balancer which can compensate for the imbalance amount with accurate when the rotational speed of a rotor is not only below the resonance speed but also near or above the resonance speed.

Technical Solution

In order to achieve the above object, a centrifuge comprises a motor, a motor shaft protruded from the motor, a rotor combined to the motor shaft, and a balancer, wherein the balancer has a balancing space which is formed by combining a cover unit with a balancer body including an annular shaped space inside and contains balls and liquid altogether.

Advantageous Effects (1) Both balls and liquid are used for a balancer. Therefore, since the balls which rapidly move to the opposite side of the position at which the weight imbalance exists and fixed by the viscosity of the liquid during the centrifugal separation process, the balancing effect is excellent.

(2) A problem of the conventional ball balancer that balls are continuously moving by the inertial force after the balls moved to the opposite side of the position at which the weight imbalance exists is resolved, wherein the problem is the disadvantage of the conventional ball balancer.

(3) The present invention prevents the instability of the overall system according to the abnormal vibration of the liquid during high speed rotational motion. (4) Since each ball moving to the outer side of the balancing space by the centrifugal force contact with, the inner wall of the outer side of the balancer body at least at two or more points, each ball is fixed in some degree along the vertical direction. Therefore, the vibration attenuation effect along the vertical direction is excellent.

(5) The balancing space containing balls and liquid takes a shape of wave by the balancer body or the cover unit. Thus, because balls can reach the space taking the shape of wave safe and sound after the balls move to the opposite side of the position at which the weight imbalance amount among samples exists, the centrifuge according to the present invention can achieve more stable balancing effect.

(6) The balancing space can contain different balls in size. Because relatively bigger balls compensate for the major weight imbalance amount and relatively smaller balls play a role of compensating for the minor imbalance, the centrifuge according to the present invention can achieve faster and more accuracy balancing effect.

(7) Since the balancing space is formed by multilayer, moments existing in the up and down parts of rotor due to the weight imbalance among samples can be offset. In addition, each of multilayered balancing spaces independently can compensate for the imbalance amount of samples.

(8) Each of distances between the center of the balancer and each of balls in the balancer can be made differently by dividing the balancing space with bulkheads. The balancing space can contain different balls in size. Because the balls positioned at the outermost of the balancing space compensate for the major weight imbalance amount and the balls located at the inside of the balancing space play a role of compensating for the minute imbalance, the centrifuge according to the present invention can compensate accurately for imbalance.

(9) Consequently, the noise and the vibration generated due to the high speed rotation of the motor during the centrifugal separation process are reduced. Therefore, the damage of the bottle or the test tube where samples are contained can be prevented and lives of the rotor and the centrifuge can be extended.

(10) It is unnecessary for the operator to measure directly the weight of the samples and adapt the number of samples. Therefore, the time to be taken on the centrifugal separation process can be minimized. It is possible to improve the centrifugal separation work efficiency.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

In the following, preferred embodiments according to the present invention are described in detail with reference to the accompanying drawings as follows.

Figure 1A:
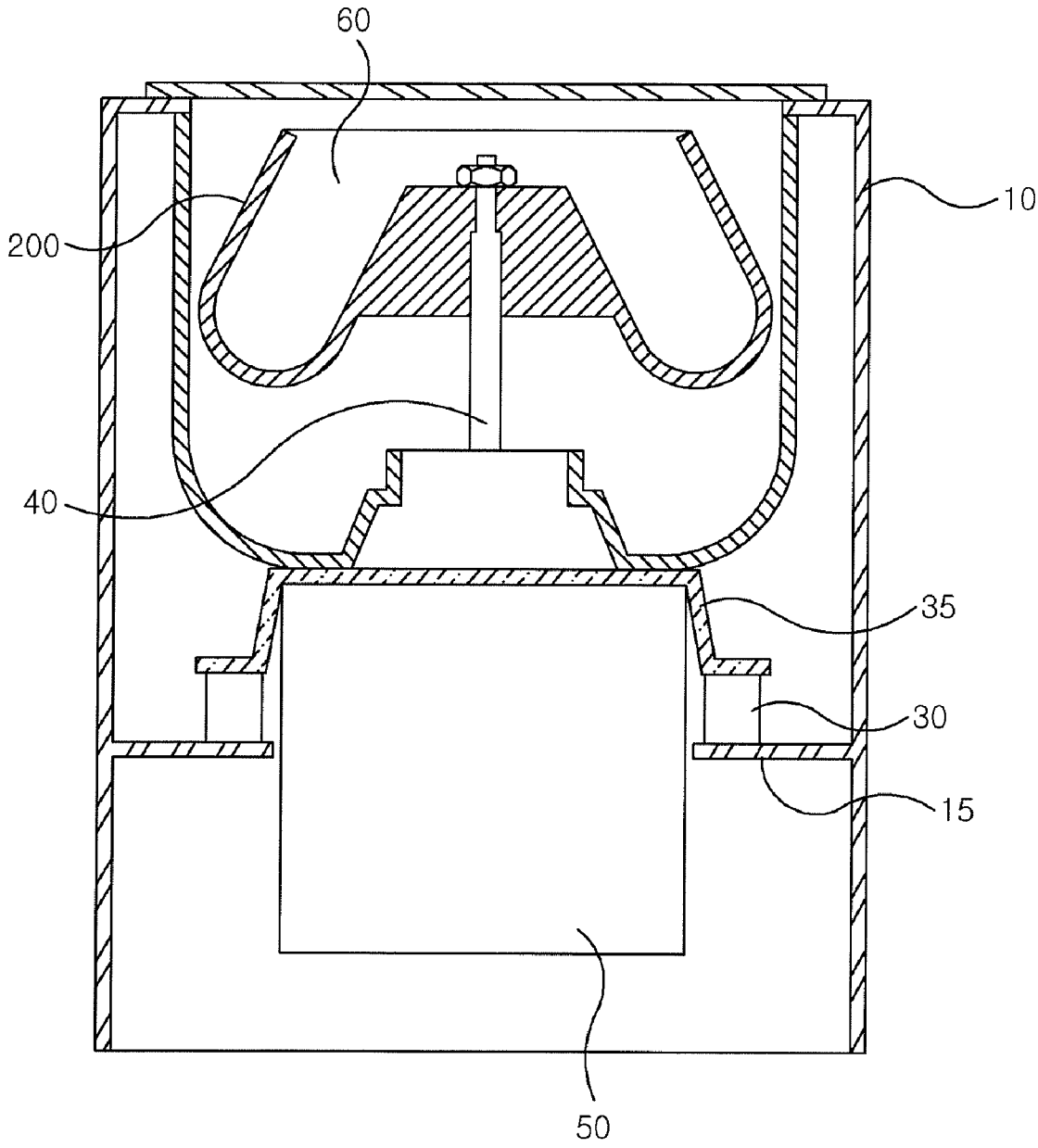
Fig. 1a Prior Art
FIG. 1*a* is a cross sectional view showing a conventional centrifuge with a fixed angle type rotor.
Figure 1B:
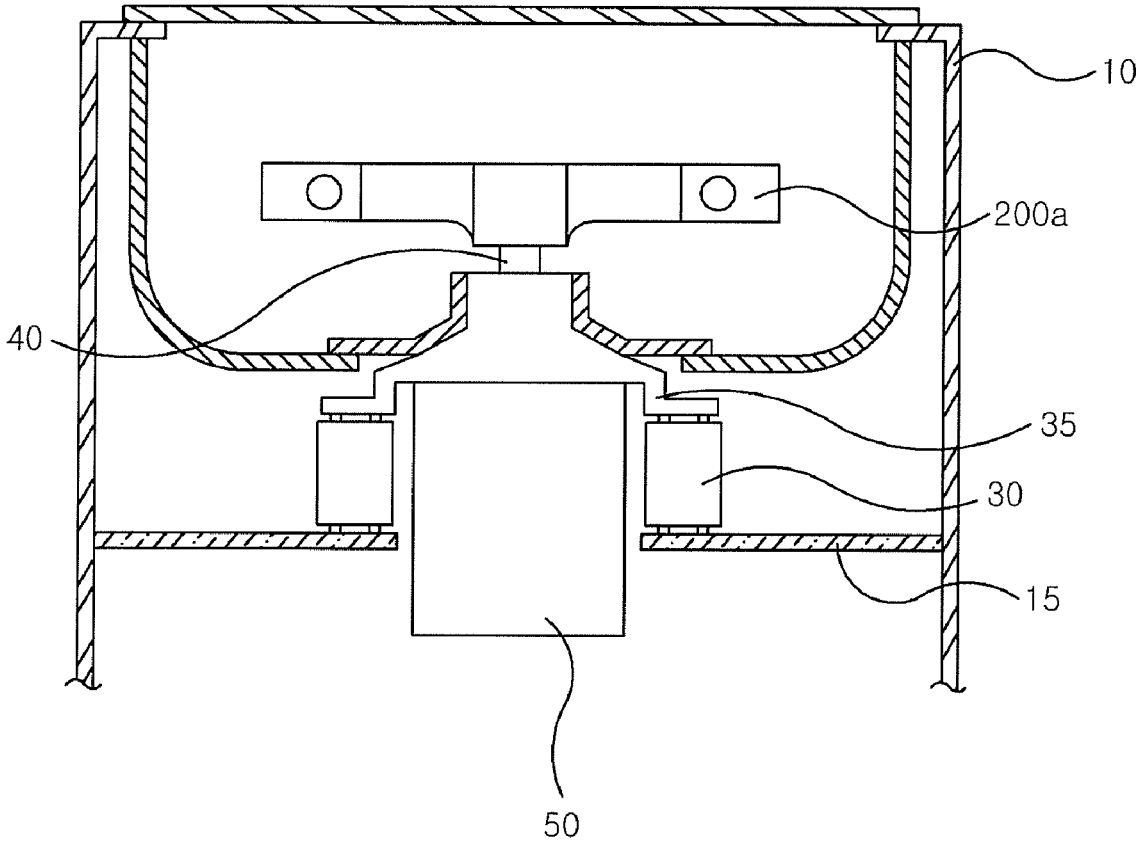
Fig. 1b Prior Art
FIG. 1*b* is a cross sectional view showing a conventional centrifuge with a swing-out type rotor.

FIG. 1*a* is an embodiment of a conventional centrifuge with a fixed-angle type rotor and FIG. 1*b* is an embodiment of another conventional centrifuge with a swing-out rotor type.

Figure 2A:
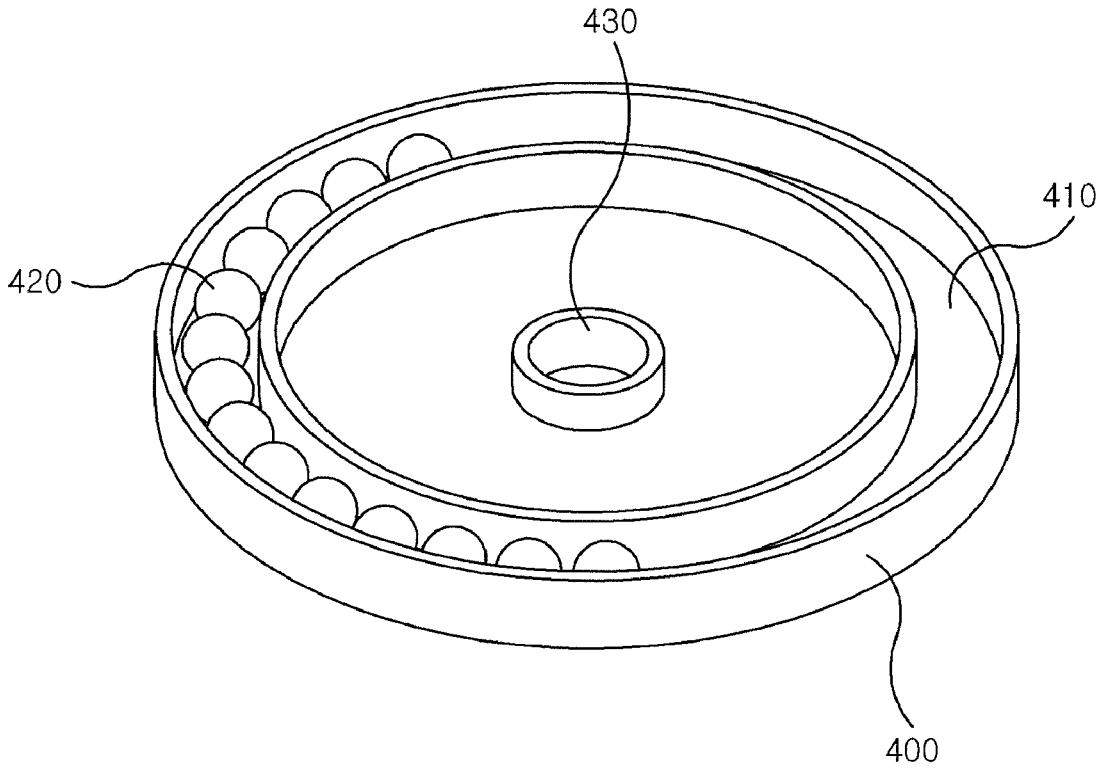
Fig. 2a Prior Art
FIG. 2*a* is a perspective view of a ball balancer according to one embodiment of Conventional Technology 1.
Figure 2B:
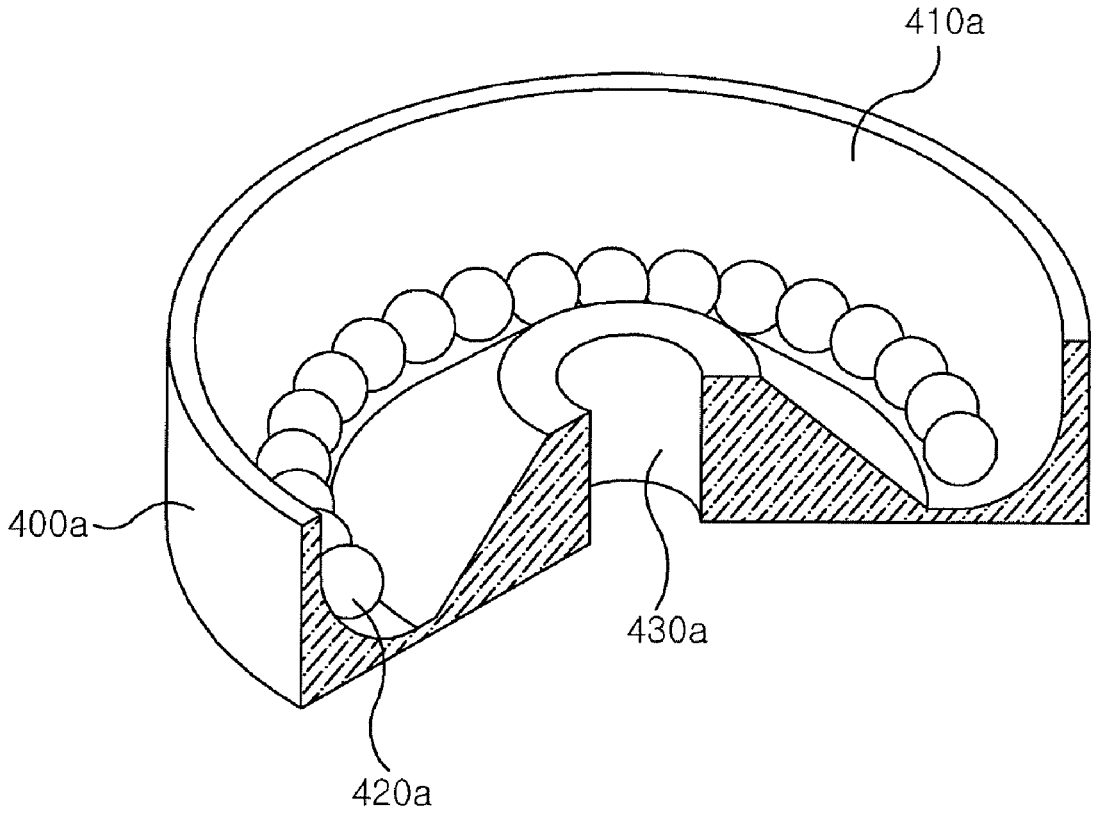
Fig. 2b Prior Art
FIG. 2*b* is a perspective view of a ball balancer according to one embodiment of Conventional Technology 2.

FIG. 2*a* is an embodiment of a ball balancer according to Conventional Technology 1 and FIG. 2*b* is an embodiment of a ball balancer according to Conventional Technology 2.

FIGS. 3*a*-3*d* are cross sectional views of centrifuges equipped with a balancer according to embodiments of the present invention.

Figure 4A:
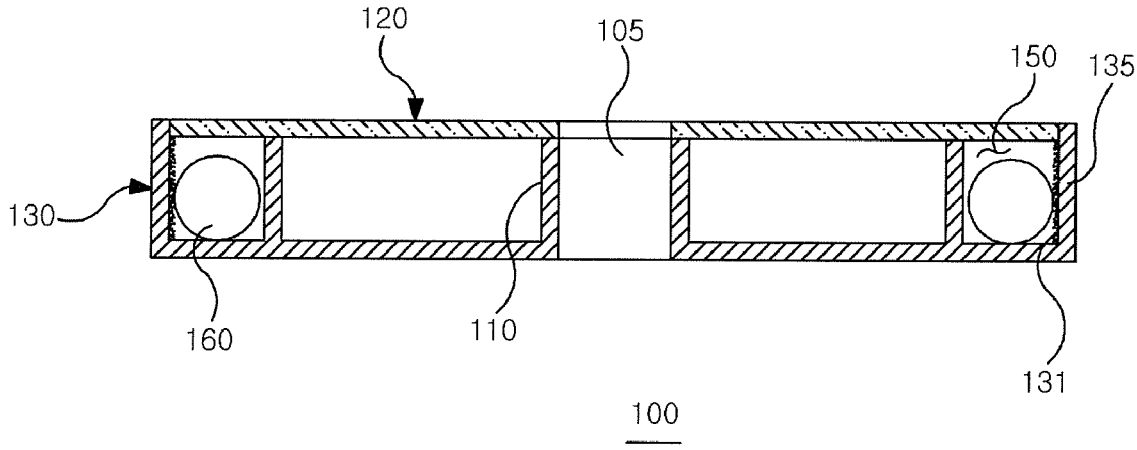
FIG. 4*a* is a cross sectional view of a balancer according to one embodiment of the present invention.
Figure 4B:
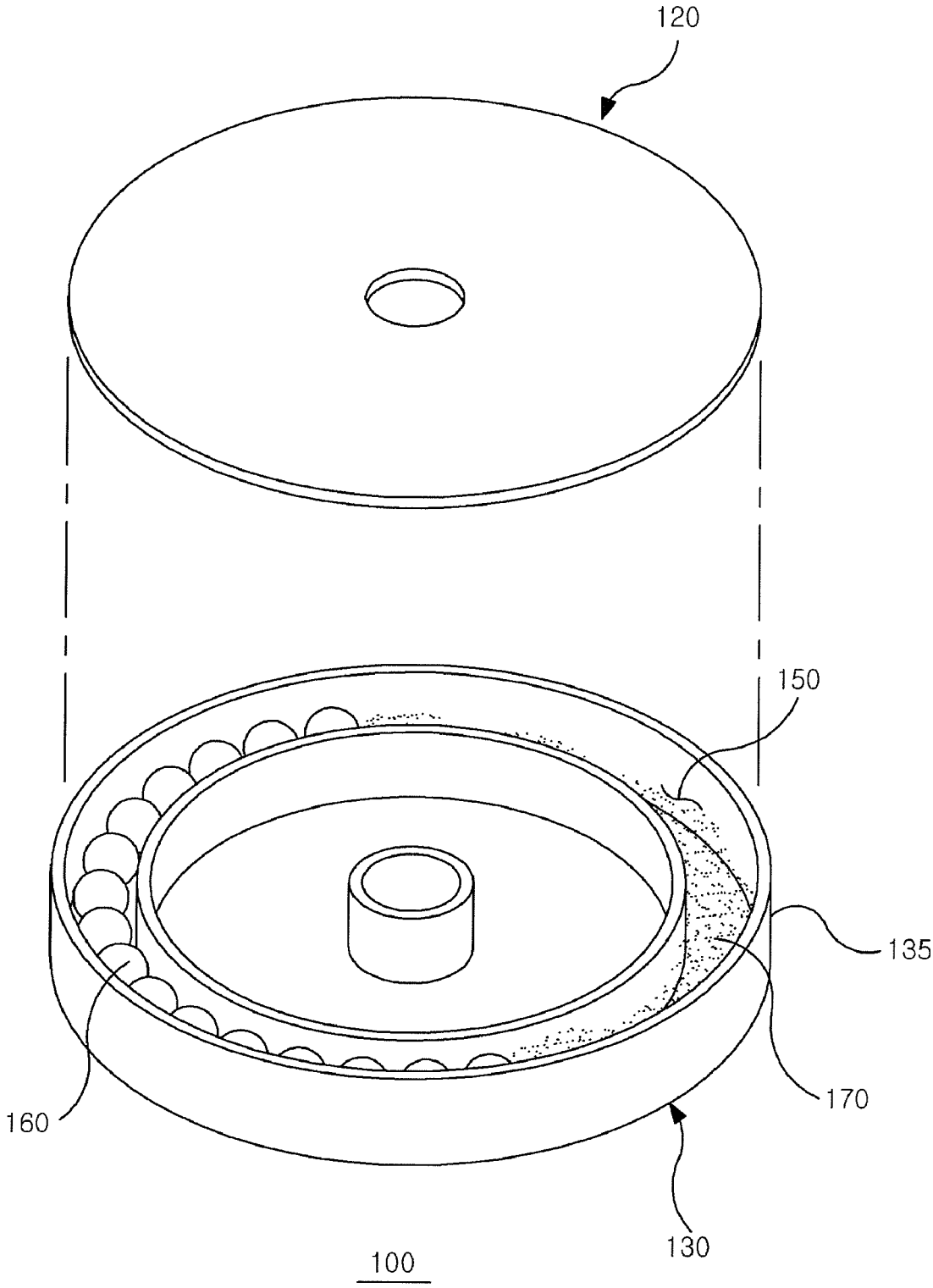
FIG. 4*b* is a perspective view of a balancer according to one embodiment of the present invention.

FIG. 4*a* is a cross sectional view of a balancer according to an embodiment of the present invention and FIG. 4*b* is a perspective view thereof.

Figure 5A:
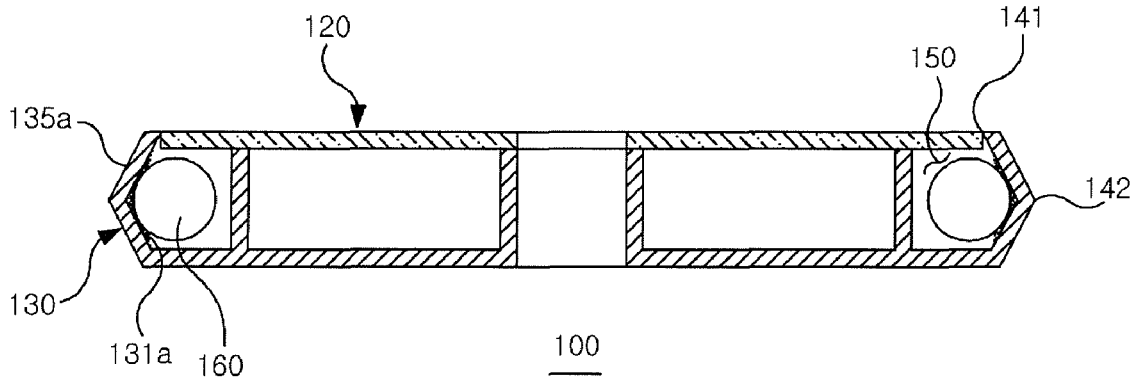
FIG. 5*a* is a cross sectional view of a balancer according to another embodiment of the present invention.
Figure 5B:
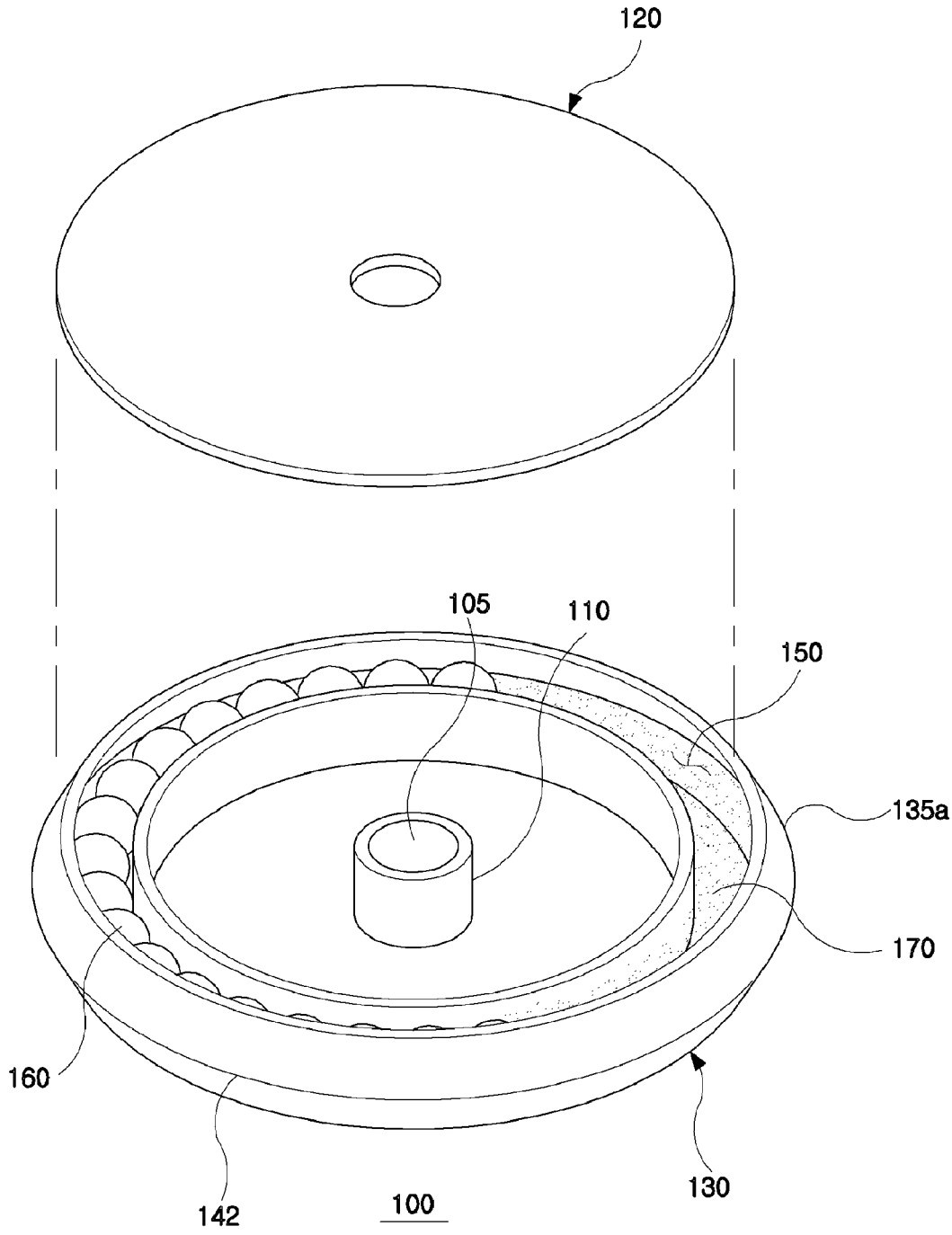
FIG. 5*b* is a perspective view of a balancer according to another embodiment of the present invention.

FIG. 5*a* is a cross sectional view of a balancer according to another embodiment of the present invention and FIG. 5*b* is a perspective view thereof.

Figure 6A:
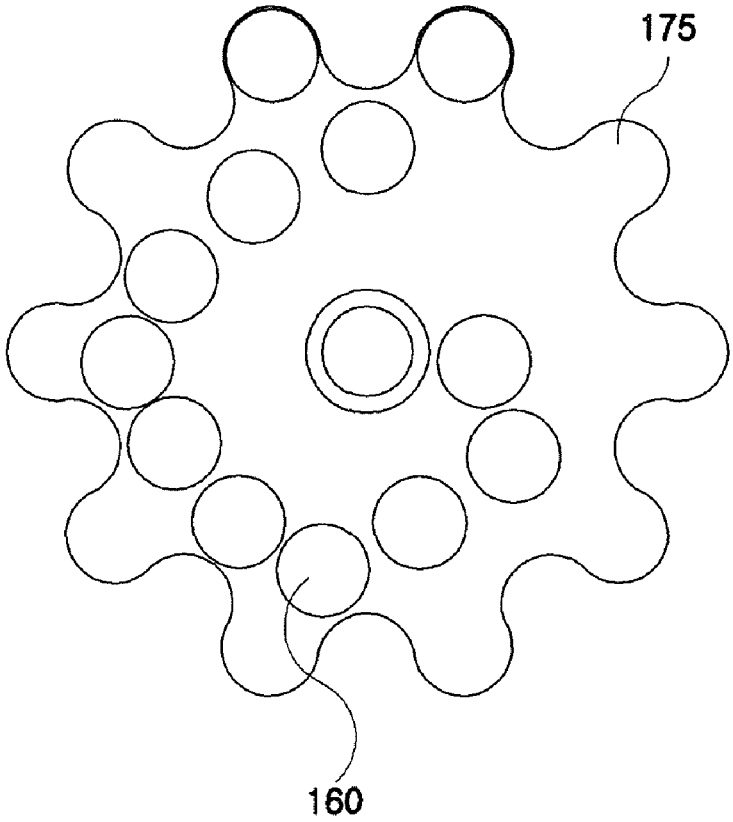
FIG. 6*a* is a plane view of a balancer according to another embodiment of the present invention.
Figure 6B:
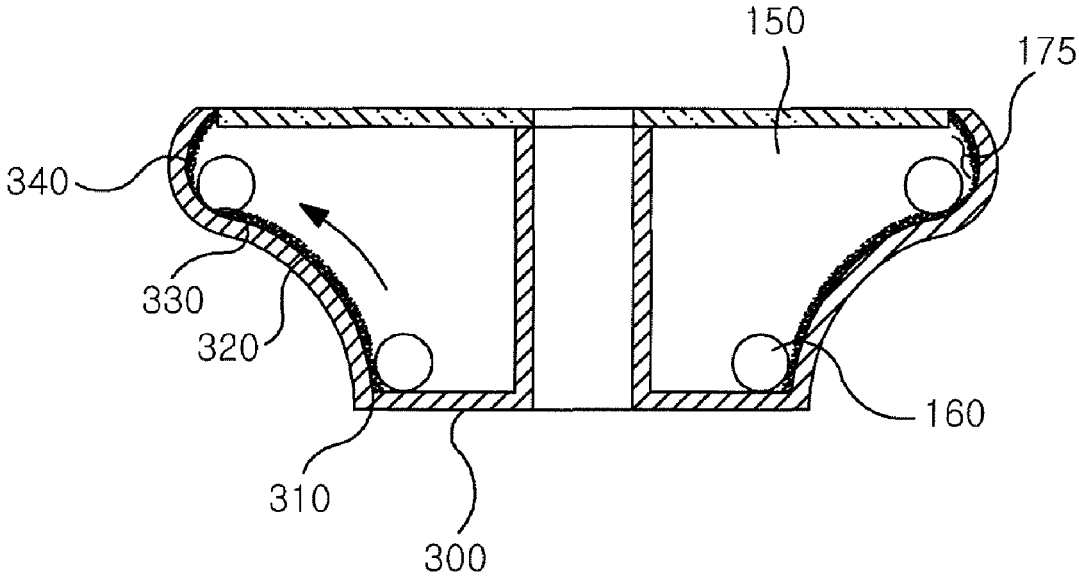
FIG. 6*b* is a cross sectional view of a balancer according to another embodiment of the present invention.
Figure 7A:
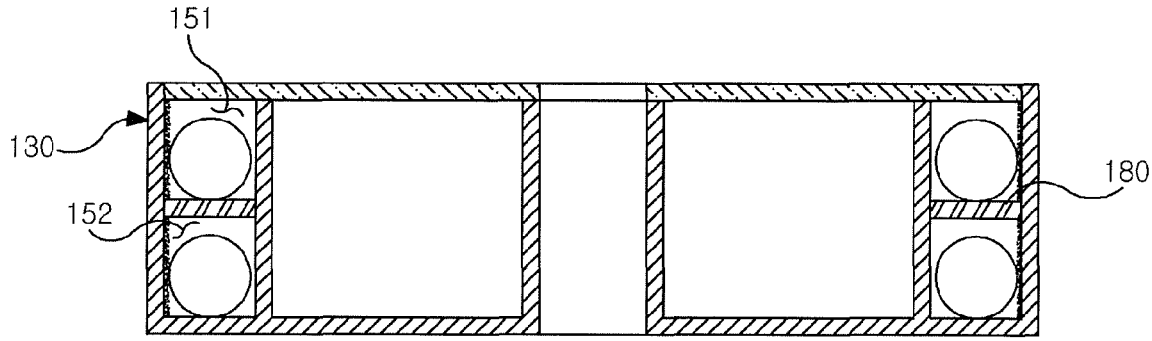
FIGS. 7*a* and 7*b* are cross sectional views of multilayer type balancers according to embodiments of the present invention.
Figure 7B:
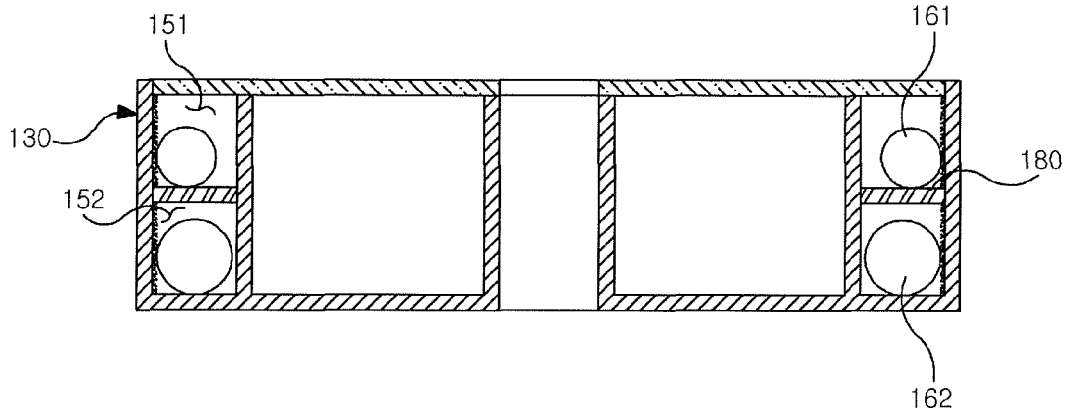
Figure 8:
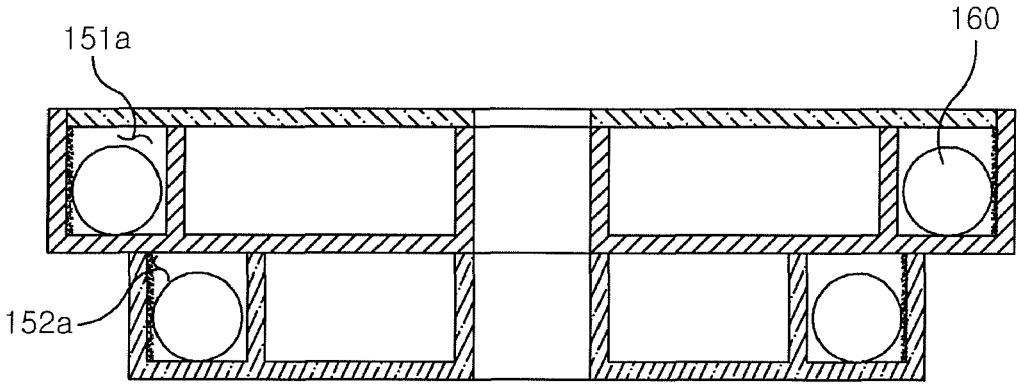
FIG. 8 is a cross sectional view of a multilayer type balancer according to another embodiment of the present invention.
Figure 9A:
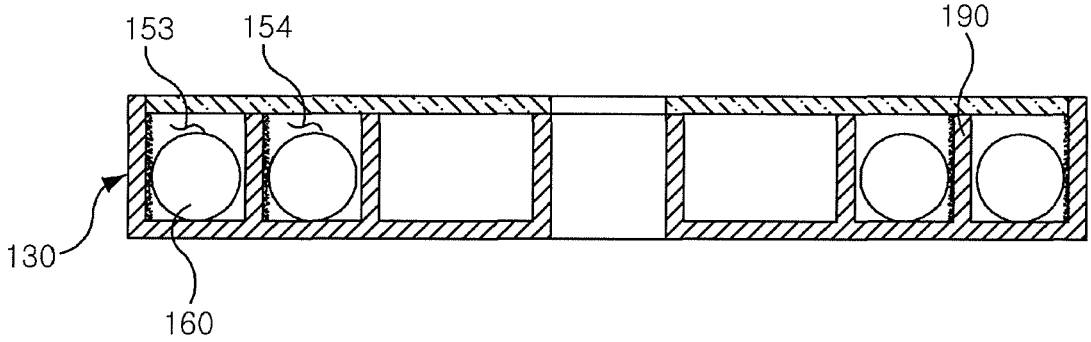
FIGS. 9*a* and 9*b* are cross sectional views of bulkhead type balancers according to embodiments of the present invention.
Figure 9B:
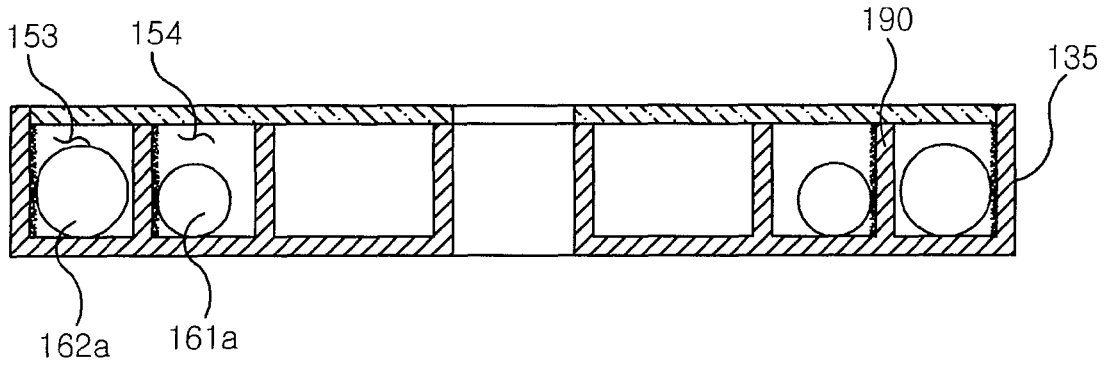
Figure 10:
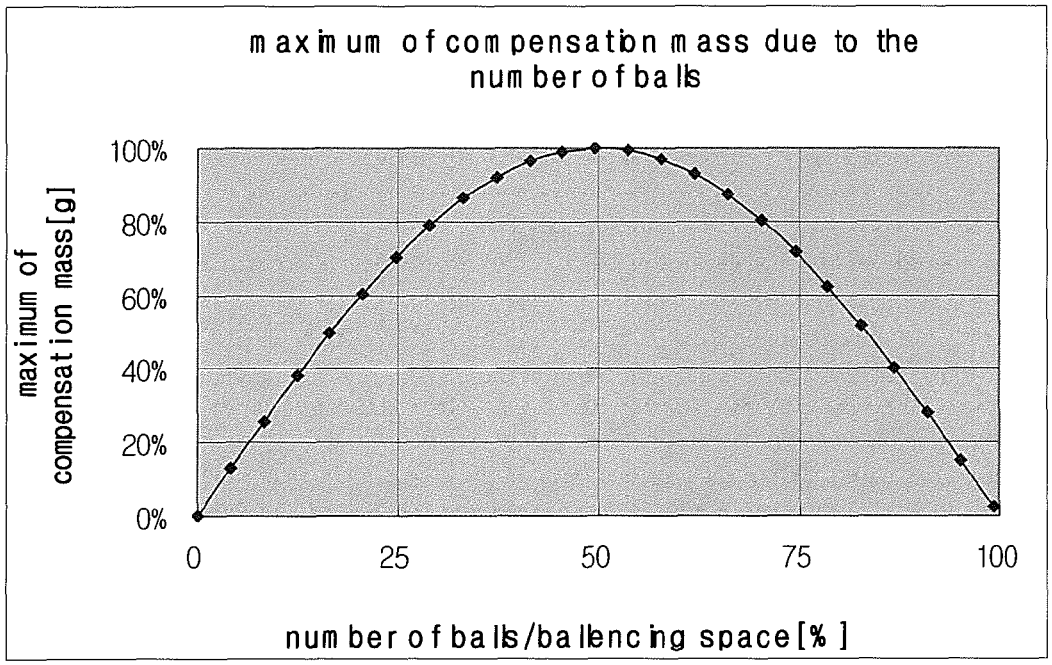
FIG. 10 is an experimental graph showing the balancing effect according to the quantity of balls.
Figure 11:
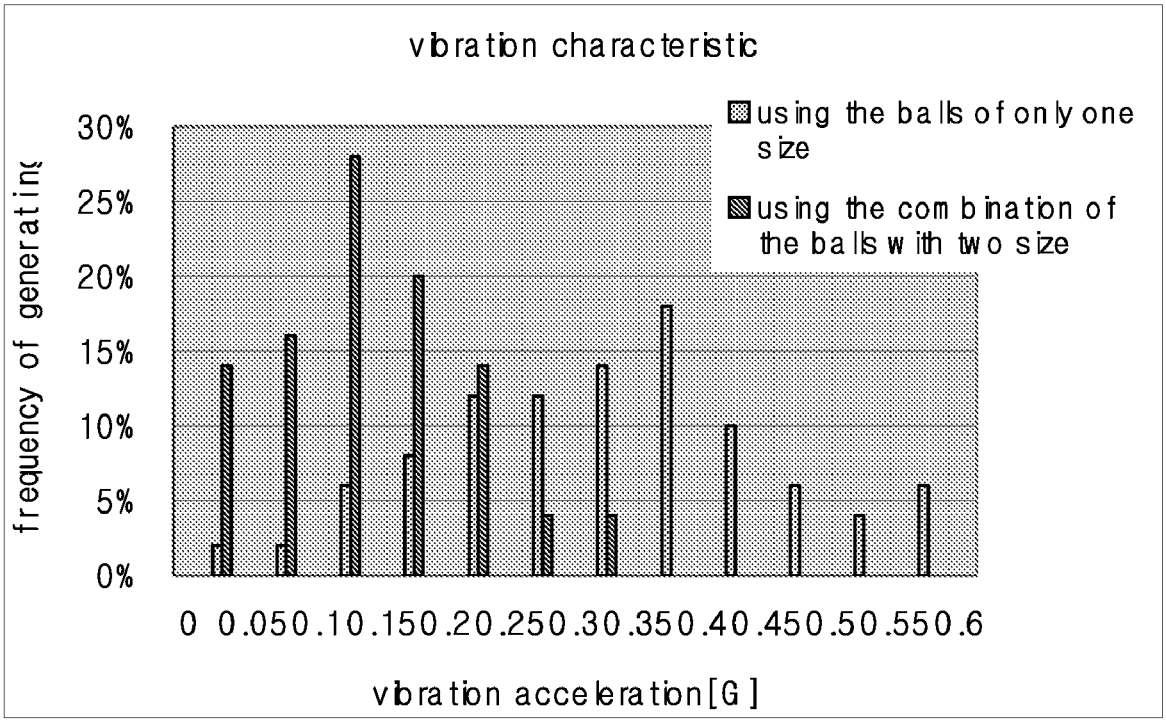
FIG. 11 is an experimental graph showing the balancing effect according to the combination of balls.

FIG. 6*a* is a plane view of a balancer according to another embodiment of the present invention and FIG. 6*b* is a cross sectional view thereof;

FIGS. 7*a*-7*b* and 8 are cross sectional views of multilayer type balancers according to embodiments of the present invention and FIG. 9*a*-*b* are cross sectional views of bulkhead type balancers according to embodiments of the present invention;

FIG. 10 is an experimental graph showing the balancing effect according to the quantity of balls and FIG. 11 is an experimental graph showing the balancing effect according to the combination of balls.

As shown in drawings, the centrifuge equipped with a balancer according to the present invention comprises a motor 50, a motor shaft protruded from motor 40, a rotor 200 or 200*a*, and a balancer 100.

Hereinafter, the present invention is illustrated on reference to FIGS. 3*a*-3*d* in detail.

The centrifuge of the present invention sets up a rotor 200 or 200*a* on the motor shaft 40 protruded from the motor 50 installed at the supporting plate 15 inside the outer case 10.

It is preferable that the motor 50 is supported by the buffer member 30 such as damper and rubber, and a second supporting plate 35.

The buffer member 30 absorbs some portion of the vibration and the noise generated at the centrifuge by the high speed rotation of the motor.

The shaft 40 of the motor protruded from the motor 50 unites with the fixed-angle rotor 200 in which a plurality of chambers 60 are formed.

Figure 3A:
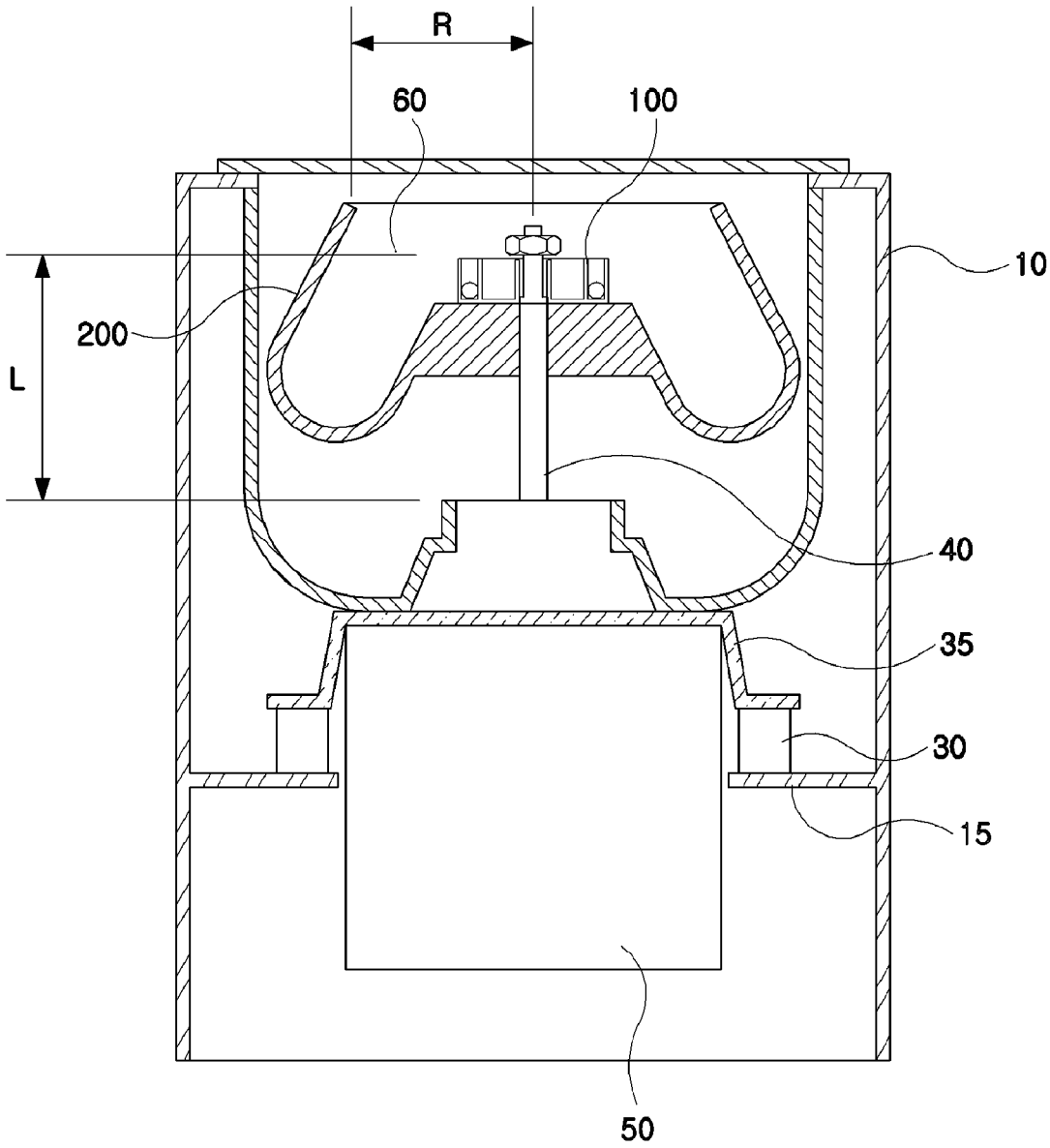
FIGS. 3*a* and 3*b* are cross sectional views of centrifuges equipped with a balancer according to one embodiment of the present invention.
Figure 3B:
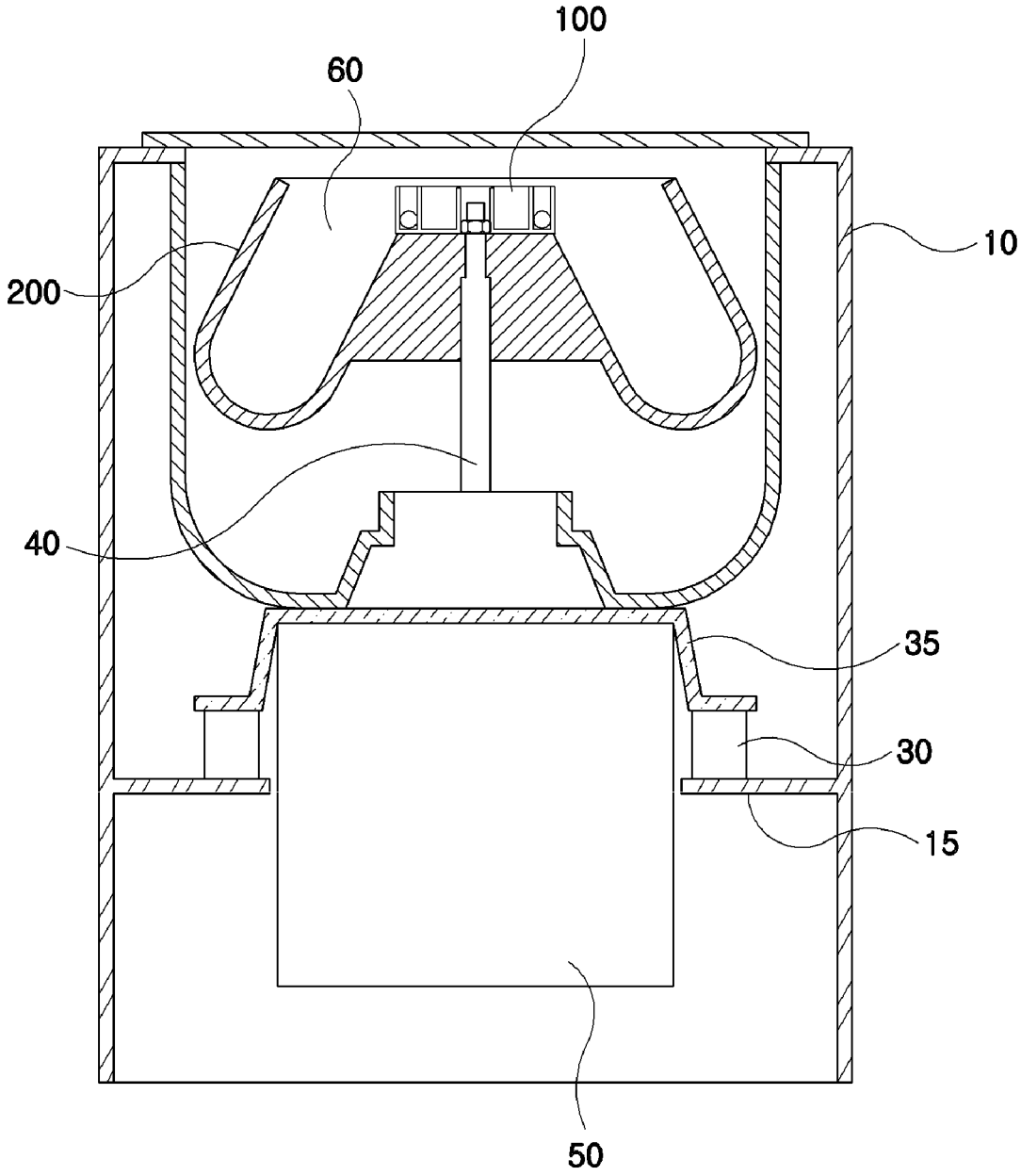

As shown in FIGS. 3*a* and 3*b*, the lower part (not illustrated) of the chamber 90 formed in the fixed-angle rotor 200 inclines about the center "of shaft 40 .of the motor to outer.

Figure 3C:
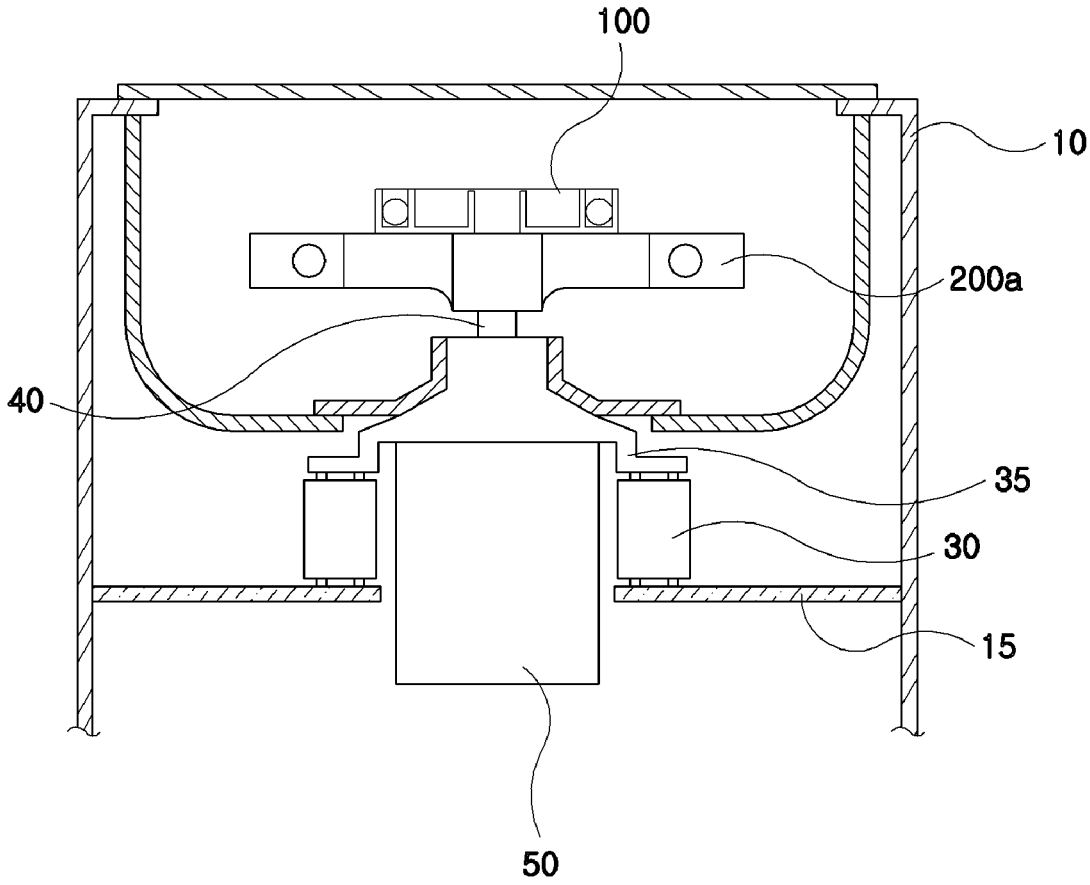
FIGS. 3*c* and 3*d* are cross sectional views of centrifuges equipped with a balancer according to one embodiment of the present invention.
Figure 3D:
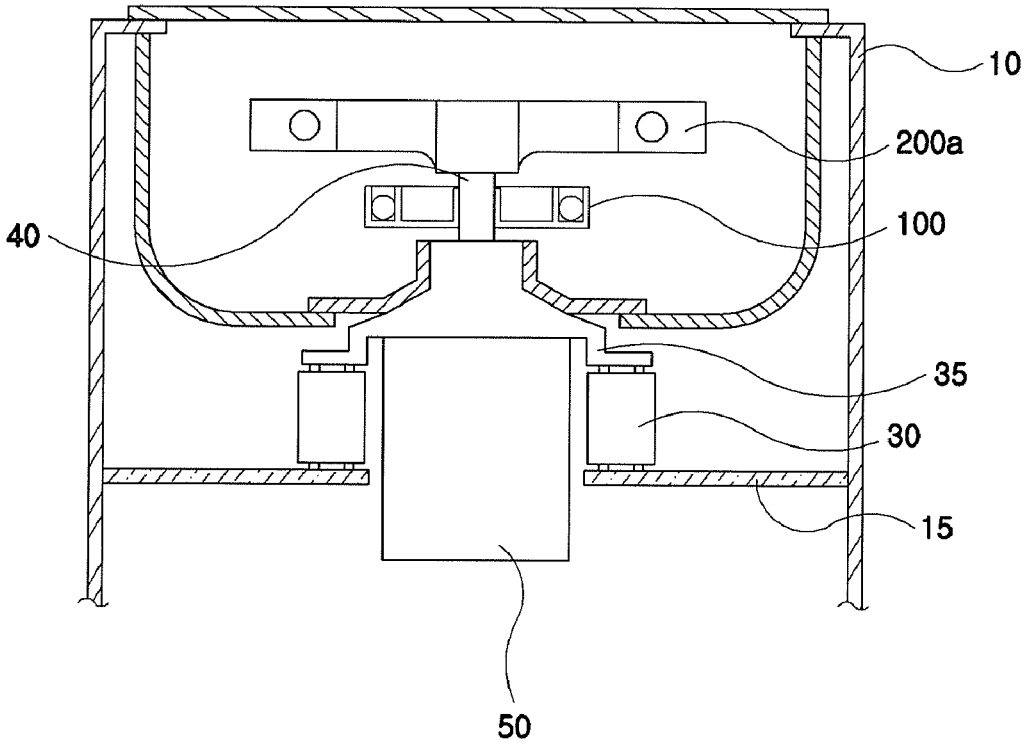

Moreover, as shown in FIGS. 3*c* and 3*d*, the centrifuge sets up the swing-out rotor 200*a* as another preferred embodiment and the swing-out rotor 200*a* rotates perpendicularly to the shaft 40 of the motor.

The swing-out rotor 200*a* comprises a ring (not illustrated) hung with a bucket (not illustrated) loading samples.

As shown in FIG. 3*a*, given the length L of the shaft 40 of the motor and the distance R between the shaft 40 of the motor and the center of mass (not illustrated) of each sample contained into the rotor 200, it is preferable that the condition of L/R<2.6 is satisfied during the centrifugal separation process.

That is, the condition described in the above means that if the length L of the shaft 40 of the motor is much longer than the distance R between the center of mass (not illustrated) of samples and the shaft 40 of the motor, during the centrifugal separation process, the rotational instability of the rotor 200 by the rotation of the motor 50 is aggravated and the balancing effect by the balancer 100 reduces.

According to experiment, it was found that if the condition of L/R<2.6 is satisfied, then the rotational instability of the rotor 200 is reduced and the balancing effect is excellent.

In the centrifuge comprised as the above, the balancer 100 to be described later is installed at a part of the shaft 40 of the motor or the rotor 200.

Hereinafter, referring to FIGS. 4*a* and 4*b*, the balancer 100 according to the present invention is illustrated in detail.

As shown in the figures, the balancer 100 is formed by combining a cover unit 120 with a balancer body 130 and has the balancing space 150 of annular form inside.

The balancer 100 has a joint 110 in which the penetration hole 105 is formed to join to the shaft of the motor or the rotor.

The balancing space 150 includes a plurality of balls 160 and liquid 170.

The balancing space 150 formed in the balancer 100 takes a shape of annular and is formed by combining the cover unit 120 with the balancer body 130.

The cover unit 120 and the balancer body 130 can be combined by several coupling methods including grooves and protrusions (not illustrated) or screws (not illustrated) formed at the corresponding locations.

These coupling methods between of two members are widely known. Therefore, the detailed description is omitted.

At the center of the balancer 100, there is a joint 110 in which the penetration hole 105 is formed to combine with a part of the shaft of the motor or the rotor.

In the balancing space 150, a plurality of balls 160 and liquid 170 are included to balance the weight imbalance amount among samples during the centrifugal separation process.

Not only water but also oil can be used as the liquid 170.

During the centrifugal separation process, the liquid 170 plays the role that the liquid fixes the balls 160 not to move by using the viscosity which is One of characteristics of the liquid 170 after the balancing completion f01' the weight imbalance amount by moving of the balls 160 to the opposite side of the weight imbalance amount.

Accordingly, the balancing effect for the weight imbalance amount is excellent in comparison with balancers which contain only balls or only liquid in the balancing space 150.

According to the condition of the centrifugal separation process, the amount and the viscosity of the liquid 170 stored in the balancing space 150 are controlled to the optimal level.

If the balancing space 150 stores excessive quantity of the liquid 170, the liquid 170 rotates at high speed continuously by the centrifugal force working on during the centrifugal separation process. Thus, the excessive quantity of the liquid works on the centrifuge as an unstable factor.

Accordingly, the abnormal vibration rather can be generated in the rotor. Therefore, it is desirable to limit the amount of the liquid to the optimal level.

Furthermore, according to the working condition, the amount of the balls 160 stored in the balancing space 150 can be controlled to the optimal level.

As shown in FIG. 10, according to experiments, when the number of balls stored in the balancing space 150 is limited to about 20%-70% of the maximum number of the balls that can be stored in the balancing space 150, the excellent balancing effect can be obtained.

As shown in FIGS. 4*a* and 4*b*, the balls 160 and the liquid 170 stored in 25 the balancer 100 is pushed to the lateral wall surface 135 of the balancer body 130 by the centrifugal force generated during the centrifugal separation process.

The shape of the lateral wall surface 135 of the balancer body 130 can be differentiated. It can form the inner wall 131*a* of the lateral wall surface 135 of the balancer body 130 to be inclined so that each of the balls 160 contacts the inner wall 131 of the lateral wall surface 135 of the balancer body 130 in at least two or more points by the centrifugal force.

Hereinafter, referring to FIGS. 5*a* and 5*b*, another embodiment of the balancer is illustrated in detail.

The lateral wall surface 135*a* of the balancer body 130 based on the horizontal direction central axis of the balancer 100 is inclined to outside.

The sloped wall is formed from the most outer part 141 of the cover unit 120 to the part 142 which has the maximum radius of the balancer 100.

Similarly, the sloped wall is formed from the most outer 142 of the floor side of the balancer body 130 to the part 142 which has the maximum radius of the balancer 100.

The lateral wall surface 135*a* and inner wall 131*a* of the balancer body are inclined by this sloped wall.

Each of the balls 160 pushed by the generated centrifugal force during the centrifugal separation process contacts with the inner wall 131*a* of the lateral wall surface 135*a* at least at two or more points.

Although the vibration along the vertical direction is generated at the rotor during the centrifugal separation process, each of the balls 160 balancing to the opposite direction of the weight imbalance amount contact with the inner wall 131*a* of the lateral wall surface 135*a* at least at two or more points.

Since the contacts working on each of the balls 160 at least at two or more points help to suppress the vertical motion of the balls 160, more stable balancing is possible.

The balancing space 150 of the balancer 100 can store a combination of the balls 160 with two sizes.

That is, in case it stores only large size balls in the balancing space 150, the balls may not be ideal and may be inclining to the fixed angle to balance the rotor.

Accordingly, the principal balancing effect and the principal balancing force are increased by using the relatively bigger sized balls.

The relatively smaller sized balls provide the rotor with better rotation stability because they are planned to give the minute balancing effect.

FIG. 11 is a comparative experimental result between a case using the balls of only one size and another case using combination of the balls with two sizes.

The vibration acceleration G is vibration generated during the centrifugal separation process. The lower the vibration acceleration is, the less the vibration and the noise of the rotor are.

As shown in FIG. 11, in case of using the combination of the balls with two sizes, the frequency of generating the vibration 25 acceleration at the rotor from 0.15 G to O. 20 G occupies about 50% and the vibration .acceleration above. 0.35 G is not generated.

However, in case of using the balls of only one size, the frequency of generating vibration acceleration at the rotor from 0.2 G to 0.40 G occupies about 70% and even 0.55 G of vibration acceleration is measured.

According to these experimental results, the balancing which is the effect of the decreased vibration is better in case of using the combination of the balls with two sizes than in case of the balls of only one size.

To store the combination of the different balls in size into the balancing space 150 can be applied to the multilayer type balancer and the bulkhead type balancer to be described later.

Hereinafter, referring to FIGS. 6*a* and 6*b*, another embodiment of balancer is illustrated in detail.

The balancer forms the lateral wall surface of the balancer body or the lateral wall surface of the cover unit as the shape of wave. Then, the space part 175 in which the balls 160 moving to the opposite side of the weight imbalance amount can stay can be formed.

The balancing space 150 formed in the balancer, that is, the lateral wall surface 135*b* of the balancer body takes a shape of wave shape when looked at the front side.

Looking the cross section of the balancing space 150, the penetration hole is made at center and the whole section takes a shape of a horn.

The floor 300 of the balancer body is plane.

At the part 310 at which the plane part of the floor 300 of the balancer body is finished, a declined part 320 is started to outside from the central axis of the balancer.

There may be a round part 340 at the part 330 at which the declined part is finished since the declined part 320 may be formed into the straight line or curve.

The space part 175 for the balls 160 and the liquid is formed inside the balancer owing to the round part 340.

If the centrifugal force works on the balls 160 located on the floor 300 of the balancer body, the balls 160 move to the outermost of the floor 300 of the balancer body comprising a part of the balancing space 150 by the centrifugal force and are positioned at the part 310 at which the declined part 320 of the balancer body starts.

As the rotational speed of the motor continuously increases, the centrifugal force acting on the balls 160 is increased and the balls 160 move along the declined part 320.

The balls 160 moving along the declined part 320 are positioned at the opposite direction of the weight imbalance amount for balancing the rotor.

At this time, the balls 160 safely reach a space part 175 formed by the round part 340 initiated from the part 330 at which the declined part 320 is finished inside the balancer.

Since the balls 160 reaching the space part 175 formed safely, after balancing at the opposite side of the weight imbalance amount, the balls are not influenced although the vibration along the vertical direction is generated at the rotor, the balancing effect is excellent.

The space part 175 can be formed .not only by making the balancer body of the balancer but also by making the lateral wall surface (not illustrated) of the cover unit as a wave shape.

It decides to omit the detailed description about this.

As shown in FIGS. 7*a* and 7*b*, the balancing space formed in the balancer can be partitioned into multilayer.

It is possible to independently compensate for the weight imbalance amount about the rotor by each of balancing spaces 151 and 152. Therefore, the rotation of the rotor can be stabilized in the fast time.

Moreover, not only the force but also the moment caused by the weight imbalance among samples included in the rotor can be offset.

Hereinafter, referring to FIGS. 7*a* and 7*b*, an embodiment of multilayer type balancer is illustrated in detail.

The balancing space can be partitioned by the bulkheads 180 which are parallel to the floor (not illustrated) of the balancer body 130 and have the shape of the circular plate on the whole.

The number of balancing spaces 151 and 152 can be adjusted by installing one or more the bulkheads 180 according to the working condition.

As shown in FIG. 7*b*, the size of the balls that are included in each of balancing spaces 151 and 152 is adjusted. While contributing to the maximum compensation mass by using the balls 162 of relatively long diameter in the lower layer 152 of the balancing space, the balls 161 of relatively short diameter are used in the upper layer 151 of the balancing space to compensate for the minute imbalance amount. The stable—balancing effect—can be obtained quickly.

As shown in FIG. 8, the distances between the balls 160 stored in each of balancing spaces 151*a* and 152*a* and the center of the balancer 100 or the shaft 40 of the motor can be differently formed.

Thus, if the distances between the balls 160 and the center of the balancer or the shaft of the motor is differently formed, the balls 160 stored in the balancing space 151*a* which relatively is positioned at outside from the center of the balancer or the shaft of the motor contribute to the maximum compensation mass.

The balls 160 stored in the balancing space 152*a* which relatively is positioned at inside from the center of the balancer or the shaft of the motor compensate for minute imbalance amount. Therefore, the stable balancing effect can be obtained in the fast time.

As shown in FIGS. 7*a*, 7*b* and 8, the balancing space in the balancer is formed with a bulkhead into the upper and lower layers. However, the balancing spaces of the upper and lower layers also can be formed by combining two or more balancers.

That is, the balancing spaces of the upper and the lower layers can be formed by combining two or more balancers with a part of the shaft of the motor or the rotor.

As shown in FIGS. 9*a* and 9*b*, the balancer is formed into a plurality of balancing spaces 153 and 154 divided by the bulkheads 190.

In this way, a plurality of balancing spaces 153 and 154 formed with the bulkheads 190 can be composed with different distances between the balls 160 stored in a plurality of balancing spaces 153 and 154 and the center of the balancer or the shaft of the motor.

The balls 160 existing in the balancing space 153 formed at the outermost one among a plurality of balancing spaces 153 and 154 divided with the bulkhead 190 mainly contribute to the maximum compensation mass of the balancer. The balls existing in the balancing space 154 near the center of the balancer play a role of compensating for the minute imbalance.

Therefore, if one balancing space is formed into a plurality of balancing spaces 153 and 154 divided by the bulkhead 190, it is possible to compensate for the imbalance amount more exactly and quickly.

Hereinafter, referring to FIGS. 9*a* and 9*b*, an embodiment of bulkhead type balancer is illustrated in detail.

The bulkhead 190 has the common center with the balancer, and is shaped as a ring on the whole, and is installed in the balancing space.

Under the necessity, one or two or more the bulkheads 190 may be installed in the balancing space. Therefore, the number of balancing spaces 151 and 152 can be adjusted.

Furthermore, as described above, the size of the balls stored in a plurality of balancing spaces 153 and 154 divided with the bulkhead 190 is adjusted. The balls 162*a* of long diameter stored in the balancing space 153 that are positioned at relatively outside from the center of the balancer or the shaft of the motor compensate for the main imbalance amount.

The balls 161*a* of relatively short diameter stored in. the balancing space 154 that are positioned at relatively inside from the center of the balancer or the shaft of the motor compensate for the minute imbalance amount. Therefore, it is possible to compensate for the imbalance amount more exactly and quickly.

Furthermore, as the balancer having one balancing space 150 is formed into a plurality of balancing spaces 153 and 154 with the bulkheads 190, a plurality of balancing spaces 153 and 154 can be formed by combining the balancer.

That is, a balancer (not illustrated) of relatively short diameter can be combine with the inner space (not illustrated) of a balancer of relatively long diameter by the corresponding grooves, protrusions and screws. Then, the combined balancer can unite with the shaft of the motor or the rotor.

As described above, although the present invention is described with reference to the preferred embodiment of the present invention, the person skilled in the art can modify or change the present invention in many ways without departing from the spirit or scope of the present invention described within the following claims.

What is claimed is:

1. A centrifuge equipped with a balancer, comprising:

a motor;

a motor shaft protruded from the motor;

a rotor mounted on the motor shaft; and a balancer, wherein the balancer has an annular balancing space formed by combining a cover unit with a balancer body, and containing balls and liquid; and wherein the outermost lateral wall of the balancer body is in a wave shape to give the balancing space a wave shape when look at the front side; and wherein the whole section of the balancer takes a shape of a horn.

2. The centrifuge equipped with a balancer of claim 1, wherein each of the balls has at least two or more contact points to an inner side of an outermost lateral wall of the balancer body.

3. The centrifuge equipped with a balancer to claim 2, wherein the number of the balls in the balancing space is 20%-70% of the maximum number of the balls that can enter the balancing space.

4. The centrifuge equipped with a balancer to claim 1, wherein the number of the balls in the balancing space is 20%~70% of the maximum number of the balls that can enter the balancing space.

* * * * *